US007490660B2

(12) United States Patent
Song

(10) Patent No.: US 7,490,660 B2
(45) Date of Patent: Feb. 17, 2009

(54) COUPLING STRUCTURE OF HEAT TRANSFER PLATE AND GASKET OF PLATE TYPE HEAT EXCHANGER

(75) Inventor: Young-ho Song, Gimhae-si (KR)

(73) Assignee: DHP Engineering Co., Ltd., Gyeongsangnam-Do (KR)

( * ) Notice: Subject to any disclaimer, the term of this patent is extended or adjusted under 35 U.S.C. 154(b) by 309 days.

(21) Appl. No.: 11/396,470

(22) Filed: Apr. 4, 2006

(65) Prior Publication Data

US 2006/0249282 A1 Nov. 9, 2006

(30) Foreign Application Priority Data

May 9, 2005 (KR) ..... 10-2005-0038306

(51) Int. Cl.
*F28F 3/08* (2006.01)

(52) U.S. Cl. ..... 165/167; 165/166

(58) Field of Classification Search ..... 165/164–167
See application file for complete search history.

(56) References Cited

U.S. PATENT DOCUMENTS 3,372,744 A * 3/1968 Skoog ..... 165/167
4,063,591 A * 12/1977 Usher ..... 165/167
4,284,135 A * 8/1981 Almqvist et al. ..... 165/166
4,911,235 A * 3/1990 Andersson et al. ..... 165/167
5,522,462 A * 6/1996 Kumar et al. ..... 165/166
6,062,305 A * 5/2000 Persson ..... 165/167
6,070,658 A * 6/2000 Cipriani ..... 165/166
6,186,224 B1 * 2/2001 Seidel ..... 165/166
6,309,519 B1 * 10/2001 Napper ..... 204/228.6
6,478,081 B1 * 11/2002 Shaw ..... 165/167

* cited by examiner

*Primary Examiner*—Ljiljana (Lil) V Ciric
(74) *Attorney, Agent, or Firm*—Bacon & Thomas, PLLC

(57) ABSTRACT

A coupling structure of a heat transfer plate and a gasket for use in a plate type heat exchanger. The heat transfer plate has a groove for receiving the gasket. The coupling structure includes a protrusion formed at a first surface of the gasket, a recess formed at a second surface of the gasket having the same shape as the protrusion, and an inverted U-shaped prominent portion formed at the bottom of the gasket groove of the heat transfer plate. A prominent portion of the heat transfer plate is tightly inserted into the recess of the gasket, and the protrusion of the gasket located under the prominent portion of the heat transfer plate is inserted into a recessed internal space of the prominent portion.

2 Claims, 3 Drawing Sheets

*(Prior Art)*

COUPLING STRUCTURE OF HEAT TRANSFER PLATE AND GASKET OF PLATE TYPE HEAT EXCHANGER

BACKGROUND OF THE INVENTION

1. Field of the Invention

The present invention relates to a structure of coupling a heat transfer plate and a gasket, for use in a plate type heat exchanger, to each other.

2. Description of the Related Art

Referring to FIG. 1, a conventional heat transfer plate, for use in various kinds of plate type heat exchangers, is shown in plan view. As shown in FIG. 1, the heat transfer plate 10, made of a thin metal plate, includes: corrugated heat transfer channels 11 formed at the substantially overall surface thereof; and first and second fluid passage holes 12 and 12' perforated through respective corners thereof at the outer side of the heat transfer channels 11. In use, a plurality of the heat transfer plates 10 are closely stacked one above another so that first and second heat exchanging fluids, i.e. a first heating or cooling fluid and a second fluid to be heated or cooled, are able to alternately flow between the stacked heat transfer plates 10. For this, a gasket 20 is inserted in a gasket groove formed at a respective one of the heat transfer plates 10. The gasket groove is formed along the outer circumference of the first and second fluid passage holes 12 and 12' and the heat transfer plate 10.

Thereby, the gasket 20 is inserted along the outer circumference of the first and second fluid passage holes 12 and 12' and the heat transfer plate 10 and, then, a plurality of the heat transfer plates 10 are closely stacked one above another. In this case, by allowing the first and second fluid passage holes 12, located at opposite sides of the heat transfer plate 10, to be alternately sealed by the gasket 20, a plate type heat exchange, in which the first and second heat exchanging fluids are able to alternately flow through the gaps between the respective heat transfer plates 10, can be manufactured. In the case of the plate type heat exchanger manufactured as stated above, the corrugated heat transfer channels 11, which are closely formed at the heat transfer plate 10 made of a thin metal plate, act to forcibly create a turbulent flow of the fluids, achieving a great increase in the heat transfer coefficient of the heat exchanger. Specifically, the heat transfer efficiency of the plate type heat exchanger can be increased three fold that of conventional multi-tube type heat exchangers. The increased high heat transfer efficiency, furthermore, enables a reduction in the size and weight of the heat exchanger. Thus, the plate type heat exchanger has been widely applied in the heat exchanger field of various facilities including ships, and the demand thereof has been grown by leaps and bounds.

However, in spite of the above described many advantages, the plate type heat exchanger is problematic because the seal between the respective heat transfer plates 10 is obtained only using the gaskets 20 made of rubber. In this case, physical and chemical properties of the gasket 20 and the coupling structure and coupling strength of the heat transfer plate 10 and the gasket 20 greatly influence the heat resistance and pressure resistance of the plate type heat exchanger. This heavily restricts the kind, use temperature, and pressure of fluids usable with the plate type heat exchanger.

Among the above mentioned several factors restricting the applicability of the plate type heat exchanger, the coupling structure of the heat transfer plate 10 and the gasket 20 has the largest effect on the pressure resistance of the plate type heat exchanger. Referring to FIG. 2 illustrating the coupling structure of the conventional heat transfer plate and gasket, in a state wherein the gasket 20, having an approximately hexahedral cross section, is inserted in the gasket groove 13 of the lower heat-transfer plate 10, the gasket 20 is pressed downward by a lower surface of the gasket groove 13 of the upper heat transfer plate 10, thereby being coupled with both the heat transfer plates 10.

However, when the heat transfer plate 10 and the gasket 20 are coupled with each other in the above described manner, the gasket 20 is easy to rotate in the gasket groove 13 or to be separated from the heat transfer plate 10. More specifically, if the hardness of the gasket 20 is deteriorated due to usage at high temperature and pressure that is exhibited in a lubricant cooler of ships, an internal pressure P applied in an outward direction of the heat transfer plate 10 causes the gasket 20 to rotate in the gasket groove 13 or to be pushed out of the heat transfer plate 10, resulting in a frequent leakage of fluids. This tends to induce a severe deterioration in the continuous operation property of the heat exchanger, and results in environmental contamination and dangerous large-scale accidents when the heat exchanger is used in a petrochemical plant.

Conventionally, to solve the above problems, an adhesive has been applied to the surface of the gasket 20 so that the gasket 20 is affixed to the gasket groove 13 of the heat transfer plate 10. Alternatively, a certain coupling structure has been provided at the gasket 20 or the heat transfer plate 10 to firmly secure the gasket 20 to the heat transfer plate 10 with an improved coupling strength. The former adhesive coupling manner, however, has several problems, such as corrosion of the heat transfer plate 10 and the gasket 20 by the adhesive, and unintentional chemical actions between the adhesive and heat exchanging fluids. Also, in the case of the latter non-adhesive coupling manner, the coupling structure disadvantageously increases the manufacturing costs of the heat transfer plate 10 or the gasket 20 and complicates the process of fixing the gasket 20 to the heat transfer plate 10, resulting in a deterioration in the overall productivity and price competitiveness of the plate type heat exchanger.

SUMMARY OF THE INVENTION

Therefore, the present invention has been made in view of the above problems, and it is an object of the present invention to provide a coupling structure of a heat transfer plate and a gasket for use in a plate type heat exchanger wherein a gasket groove, formed along the outer circumference of respective fluid passage holes and the heat transfer plate, and the gasket to be inserted into the gasket groove have a toothed engagement coupling structure, whereby the coupling structure of the heat transfer plate and the gasket is remarkably simplified, while the contact area between the heat transfer plate and the gasket and the resulting coupling strength can be greatly improved, and thus, pressure resistance of the plate type heat exchanger can be greatly improved to allow the plate type heat exchanger to be easily applied to high temperature and pressure heat exchanger facilities.

In accordance with the present invention, the above and other objects can be accomplished by the provision of a coupling structure of a heat transfer plate and a gasket for use in a plate type heat exchanger, the plate type heat exchanger comprising: a plurality of the heat transfer plates closely stacked one above another, each heat transfer plate having corrugated heat transfer channels formed at the substantially overall surface thereof, first and second fluid passage holes perforated through respective corners thereof, and a gasket groove formed along the outer circumference of the fluid passage holes and the heat transfer plate; and one or more gaskets each inserted into the gasket groove of a respective one of the heat transfer plates to allow first and second heat exchanging fluids, i.e. a first heating or cooling fluid and a second fluid to be heated or cooled, to alternately flow between the stacked heat transfer plates, wherein the coupling structure comprises: a protrusion formed at a first surface of a respective one of the gaskets; a recess formed at a second surface of the gasket and having the same shape as the protrusion; and an inverted U-shaped prominent portion formed at the bottom of the gasket groove of a respective one of the heat transfer plates, whereby the prominent portion of the heat transfer plate is tightly inserted into the recess of the gasket located thereon, and in turn, the protrusion of the gasket, located under the prominent portion of the heat transfer plate, is inserted into a recessed internal space of the prominent portion.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be explained with reference to the accompanying drawings.

Figure 1:
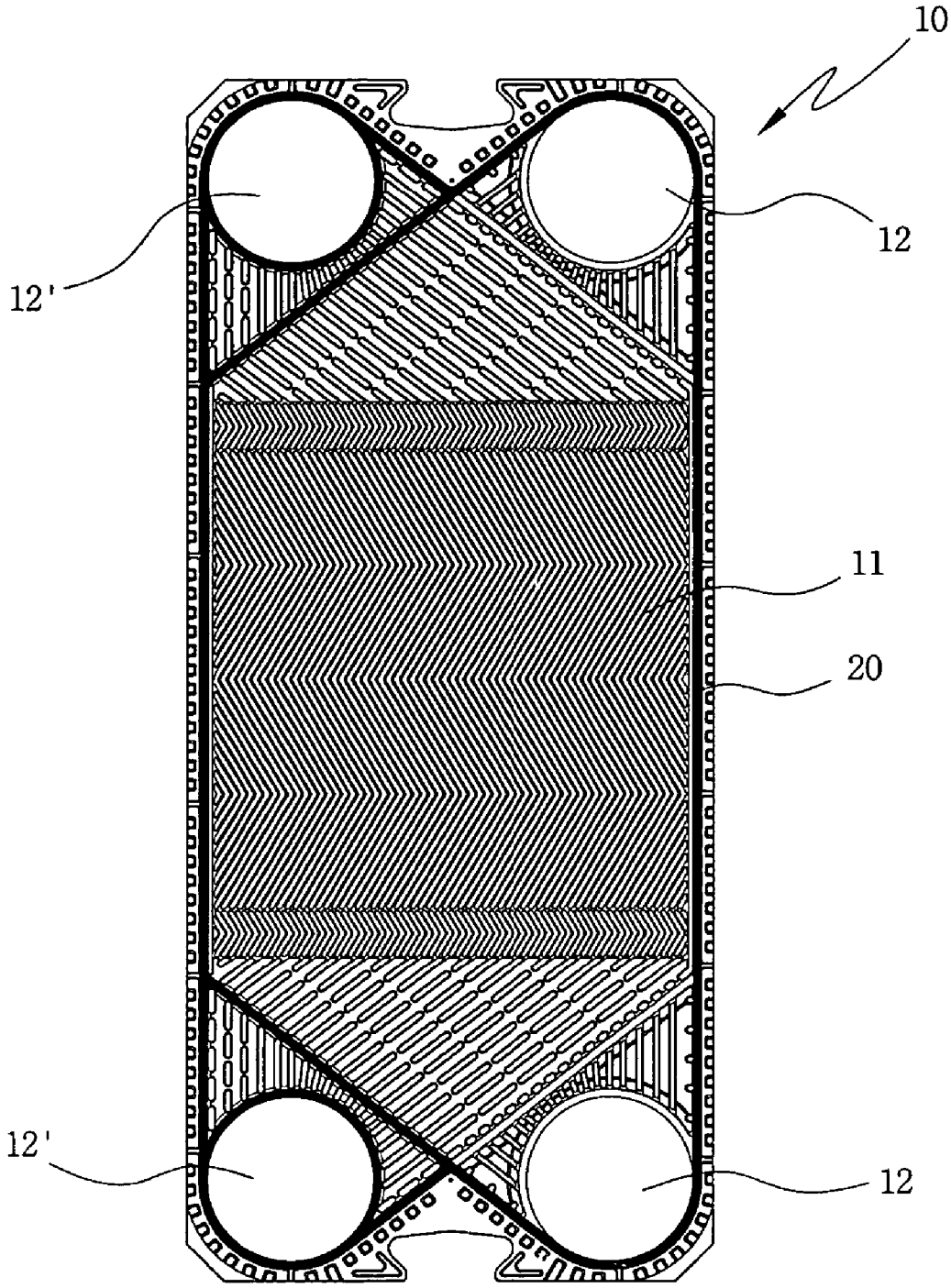
FIG. 1 is a plan view illustrating a conventional heat transfer plate for use in a plate type heat exchanger.
Figure 2:
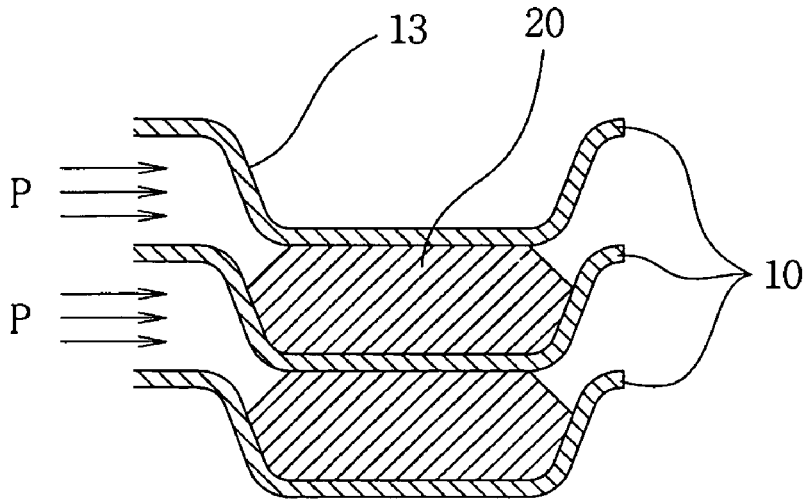
FIG. 2 is an enlarged partial side sectional view illustrating the coupling structure of the conventional heat transfer plate and gasket.
Figure 3:
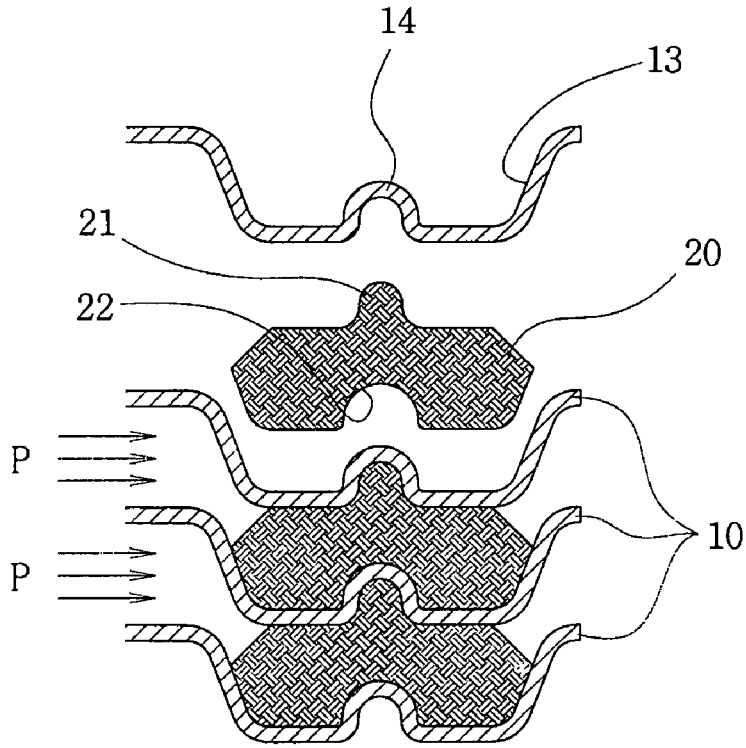
(Prior Art) FIG. 3
FIGS. 3 and 4 are enlarged partial side sectional views illustrating the coupling structure of a heat transfer plate and a gasket according to different embodiments of the present invention.
Figure 4:
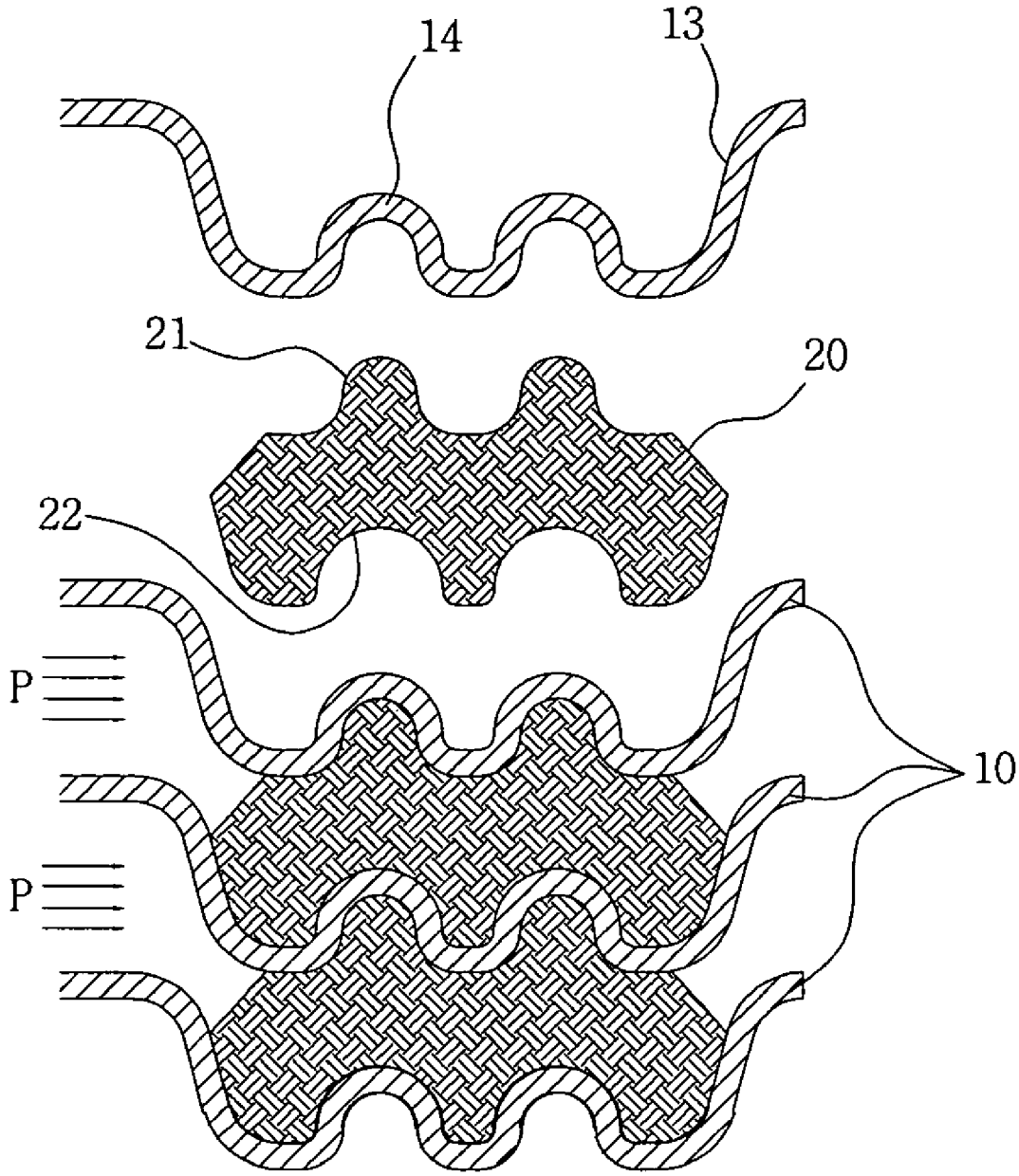

FIGS. 3 and 4 are enlarged partial side sectional views illustrating the coupling structure of a heat transfer plate and a gasket according to the preferred embodiments of the present invention. Hereinafter, parts corresponding to those of the prior art are denoted by the same reference numerals as those of the prior art.

Referring first to FIG. 3, the coupling structure of a heat transfer plate and a gasket, for use in a plate type heat exchanger, according to the embodiment of the present invention comprises: a protrusion 21 formed at an upper surface of a gasket 20 having an approximately hexahedral cross section; a recess 22 formed at a lower surface of the gasket 20 and having the same shape as the protrusion 21; and an inverted U-shaped prominent portion 14 formed at the bottom of a gasket groove 13 of a heat transfer plate 10 and having the same shape as both the protrusion 21 and the recess 22. With this configuration, the prominent portion 14 of the heat transfer plate 10 is tightly inserted into the recess 22 of the gasket 20 located thereon, and in turn, the protrusion 21 of the gasket 20, located under the prominent portion 14 of the heat transfer plate 10, is inserted into a recessed internal space of the prominent portion 14.

The protrusion 21 is configured to protrude upward from the upper surface of the gasket 20, and is preferably located at the center of the upper surface of the gasket 20. The protrusion 21 may be formed throughout the overall length of the gasket 20, or may be formed along only part of the length of the gasket 20 in consideration of the fact that a high pressure is locally applied to the gasket during operation of the plate type heat exchanger. Also, in order to increase the contact area between the heat transfer plate 10 and the gasket 20 while ensuring easy insertion or removal of the gasket 20 into or from the gasket groove 13, the protrusion 21 preferably has a semispherical shape, but may be formed into various columns having a square, rectangular, trapezoidal, or triangular cross section. In addition, although FIG. 3 illustrates a row of the protrusion 21 formed at the upper surface of the gasket 20, two or more rows of the protrusions (See FIG. 4) may be formed at the upper surface of the gasket 20 in order to increase the contact area between the heat transfer plate 10 and the gasket 20 and the resulting coupling strength. Here, it should be noted that forming more than three rows of the protrusions is undesirable because it makes it difficult to insert the gasket 20 into the gasket groove 13. Also, the thickness of each protrusion must be reduced in consideration of the restricted width of the gasket 20, resulting in a deterioration in the strength of the protrusion.

The recess 22 is provided in the same number and shape as the protrusion 21. Preferably, the depth of the recess 22 does not exceed half of the thickness of the gasket 20 except for the protrusion 21 to prevent generation of cracks or damage to the gasket 20 when the gasket 20 is inserted into the gasket groove 13 of the heat transfer plate 10.

The prominent portion 14, formed at the gasket groove 13 of the heat transfer plate 10, is configured in consideration of dimensions of both the protrusion 21 and the recess 22 so that it is tightly inserted, at an external surface thereof, into the recess 22 while allowing the protrusion 21 to be tightly inserted into the recessed internal space thereof. Also, the prominent portion 14 is configured to enable the upper and lower surfaces of the gasket 20, formed with the protrusion 21 and the recess 22, to come into maximum contact with corresponding surfaces of the gasket grooves 13 of the heat transfer plates 10 located at the upper and lower sides thereof.

If the coupling structure of the present invention configured as stated above is applied to both the heat transfer plate 10 and the gasket 20 so that a plurality of the heat transfer plates 10 are closely stacked one above another by interposing the gaskets 20, as shown in FIG. 3, the protrusion 21 of the lower gasket 20 and the recess 22 of the upper gasket 20 are able to be firmly engaged with the upper and lower sides of the prominent portion 14 formed at the gasket groove 13 of the heat transfer plate 10 located between the upper and lower gaskets 20 and, simultaneously, the upper and lower surfaces of both the lower and upper gaskets 20 are able to come into close contact with the gasket groove 13 of the heat transfer plate 10. Therefore, even if the hardness of the gasket 20 is deteriorated due to usage at high temperature and pressure that is exhibited in a lubricant cooler of ships, the gasket 20 has no risk of rotating in the gasket groove 13 or of being pushed out of the heat transfer plate 10 even if an internal pressure P is applied thereto in an outward direction of the heat transfer plate 10. Thereby, the plate type heat exchanger of the present invention is free from the leakage of heat exchanging fluids, resulting in an advantage of continuous and safe operation thereof. This advantage is obtained by the fact that the coupling structure of the heat transfer plate 10 and the gasket 20 using both the protrusion 21 and the recess 22 according to the present invention provides a more increased contact area between the heat transfer plate 10 and the gasket 20 as compared to the prior art. The increased contact area between the heat transfer plate 10 and the gasket 20 considerably improves a frictional force of the gasket 20 resistant to the internal pressure P. Thus, even if the internal pressure P, applied in the outward direction of the heat transfer plate 10, acts as a shear force, the coupling structure of the present invention is able to easily support or disperse the shear force via the toothed engagement of the gasket 20 and the gasket groove 13. This has the effect of greatly improving pressure resistance of the plate type heat exchanger.

Further, the coupling structure of the present invention allows the heat transfer plate 10 and the gasket 20 to be coupled to each other in a non-adhesive coupling manner. In this case, differently from the conventional coupling structure using an adhesive, it is possible to prevent not only the corrosion of the heat transfer plate 10 and the gasket 20, but also certain chemical reactions between heat exchanging fluids and an adhesive. Furthermore, differently from the conventional non-adhesive coupling structure, the coupling structure of the present invention achieves improved coupling strength between the heat transfer plate 10 and the gasket 20 by improving the cross sectional shape of the gasket 20 and the gasket groove 13, instead of adding separate coupling means to the heat transfer plate 10 and the gasket 20. As a result, the coupling structure of the present invention can contribute greatly to a reduction in the manufacturing costs of the heat transfer plate 10 and the gasket 20 as compared to the prior art. Mainly, the heat transfer plate 10 is manufactured by pressing a thin metal plate for easy formation of heat transfer channels 11, fluid passage holes 12 and 12', and the gasket groove 13. In the present invention, the prominent portion 14 is formed at the gasket groove 13 of the heat transfer plate 10 during the press operation of the heat transfer plate 10 without an increase in the manufacturing costs of the heat transfer plate 10. Similarly, the protrusion 21 and the recess 22 are able to be easily formed at the gasket 20 in the manufacture of the gasket 20. Therefore, the present invention has substantially no additional costs required to form the coupling structure to the heat transfer plate 10 and the gasket 20, and enables the gasket 20 to be easily inserted into the gasket groove 13 of the heat transfer plate 10. Consequently, the present invention can provide a plate type heat exchanger, having improved overall productivity and pressure resistance, at a low price.

Admittedly, the above description is based on a mere representative illustrative embodiment wherein the heat transfer plate 10 has a rectangular plate shape and the fluid passage holes 12 and 12' are formed at four corners of the rectangular heat transfer plate 10, those skilled in the art will appreciate that the present invention is not limited to the above description, and the coupling structure of the present invention is applicable to various other kinds of heat transfer plates for use in plate type heat exchangers, without departing from the scope and spirit of the invention.

As is apparent from the above description, the coupling structure of a heat transfer plate and a gasket for use in a plate type heat exchanger according to the present invention has the following effects.

Firstly, according to the present invention, a gasket groove, formed along the outer circumference of respective fluid passage holes and the heat transfer plate, and the gasket to be inserted into the gasket groove have a toothed engagement coupling structure. With this configuration, the coupling structure of the heat transfer plate and the gasket can be remarkably simplified, while the contact area between the heat transfer plate and the gasket and the resulting coupling strength, i.e. frictional force and supporting force, can be greatly improved. Thus, the pressure resistance of the plate type heat exchanger can be greatly improved, allowing the plate type heat exchanger to be easily applied to high temperature and pressure heat exchanger facilities.

Secondly, differently from a conventional coupling structure using an adhesive, the present invention has the effect of preventing not only corrosion of the heat transfer plate and the gasket, but also certain chemical reactions between heat exchanging fluids and an adhesive. Also, differently from a conventional non-adhesive coupling structure, the coupling structure of the present invention can achieve improved coupling strength between the heat transfer plate and the gasket by simply adapting the cross sectional shapes of the gasket and the gasket groove, instead of adding separate coupling means to the heat transfer plate and the gasket. As a result, the coupling structure of the present invention can contribute greatly to a reduction in the manufacturing costs of the heat transfer plate and the gasket as compared to the prior art. Also, the present invention enables the gasket to be easily inserted into the gasket groove of the heat transfer plate, and can provide a plate type heat exchanger, having improved overall productivity and pressure resistance, at a low price.

What is claimed is:

1. A coupling structure of a heat transfer plate and a gasket for use in a plate heat exchanger, the plate heat exchanger comprising:

a plurality of the heat transfer plates closely stacked one above another, wherein each heat transfer plate has corrugated heat transfer channels formed on a surface of the plate, fluid passage holes perforated through corners of the plate, and a gasket groove formed along the outer circumference of the fluid passage holes and the heat transfer plate; and one or more gaskets each inserted into the gasket groove of a respective one of the plurality heat transfer plates to allow first and second heat exchanging fluids to alternately flow between the stacked heat transfer plates, the coupling structure in turn comprising:

a protrusion formed longitudinally at a first surface of a respective one of the one or more gaskets;

a corresponding recess formed longitudinally at a second surface of the respective gasket; and, an inverted U-shaped prominent portion formed at the bottom of the gasket groove of a respective one of the heat transfer plates, the inverted U-shaped prominent portion having a corresponding U-shaped recessed internal space on an opposing side of the respective heat transfer plate, whereby the U-shaped prominent portion of the respective heat transfer plate is tightly inserted into the recess of the respective gasket, and in turn, the protrusion of the respective gasket is insertable into the U-shaped recessed internal space of the U-shaped prominent portion of another one of the plurality of heat transfer plates.

2. The coupling structure of claim 1, wherein each of the one or more gaskets has a generally hexahedral cross-section.

* * * * *